US006880200B2

(12) United States Patent
Yoo

(10) Patent No.: US 6,880,200 B2
(45) Date of Patent: Apr. 19, 2005

(54) SUCTION DEVICE FOR A VACUUM CLEANER

(75) Inventor: Dong-hun Yoo, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 348 days.

(21) Appl. No.: 10/205,375

(22) Filed: Jul. 25, 2002

(65) Prior Publication Data

US 2003/0208880 A1 Nov. 13, 2003

(30) Foreign Application Priority Data

May 11, 2002 (KR) ..... 2002-26041

(51) Int. Cl.[7] ..... A46B 13/00
(52) U.S. Cl. ..... 15/387; 15/377
(58) Field of Search ..... 15/377, 383, 387, 15/389

(56) References Cited

U.S. PATENT DOCUMENTS

| | | | | |
|---|---|---|---|---|
| 3,005,224 A | | 10/1961 | Magarian | |
| 4,305,176 A | | 12/1981 | Lessig, III et al. | |
| 4,397,060 A | | 8/1983 | Jinkins et al. | |
| 5,029,361 A | * | 7/1991 | Murata et al. | 15/383 |
| 6,571,424 B1 | * | 6/2003 | Roschi et al. | 15/387 |

FOREIGN PATENT DOCUMENTS

| | | | |
|---|---|---|---|
| DE | 10042670 | | 2/2001 |
| EP | 0898926 | | 3/1999 |
| GB | 2088203 | | 6/1982 |
| GB | 2105183 | | 3/1983 |
| JP | 1-166729 | * | 9/1989 |
| JP | 10127542 | | 5/1998 |

OTHER PUBLICATIONS

Page of an Instruction Manual for Siemans use of Model RK 44119, date unknown (including English translation).

* cited by examiner

*Primary Examiner*—Terrence R. Till
(74) *Attorney, Agent, or Firm*—Ladas & Parry LLP

(57) ABSTRACT

A vacuum cleaner suction device includes an upper casing member and a lower casing member that oppose each other. A rotary brush chamber in the suction device has a suction port formed therein. A turbine chamber that is separated from the rotary brush chamber but interconnected thereto through a passage formed in the partition that separates the rotary brush from the turbine chamber. The rotary brush is supported in the rotary brush chamber as is the turbine for driving the rotary brush. The turbine is rotated by an air current drawn into the vacuum cleaner. A service hole is formed on the turbine chamber of the seduction device body for partially exposing the turbine. The service hole is provided on a removable service hole cover with a locking portion for removably supporting the service hole cover. Contaminants that clog the passage to the tubing can be easily removed by opening the service hole by removing the service hole cover. Accordingly, there is no need to separate the upper and lower casing members of the suction device body. Vacuum cleaner maintenance and repair is made easier.

4 Claims, 6 Drawing Sheets

SUCTION DEVICE FOR A VACUUM CLEANER

BACKGROUND OF THE INVENTION

1. Field of the Invention

The present invention generally relates to a suction device of a vacuum cleaner, and more particularly, to a suction device of a vacuum cleaner having a rotary brush rotated by a turbine.

2. Description of the Prior Art

As widely known, a suction device of a vacuum cleaner forms a suction passage of the vacuum cleaner from a surface to be cleaned to a body of the cleaner as the vacuum cleaner moves along in contact with the surface to be cleaned. Accordingly, dust-laden air is drawn into the cleaner body through the suction port.

Meanwhile, for cleaning a fabric object like carpet, the vacuum cleaner performs more efficient cleaning operations by causing the dust of the surface to be cleaned to float in the air. For this purpose, it has been suggested that the suction device have a rotary brush that scratches or strokes the surface to be cleaned so as to let the dust of the surface float in the air.

Conventional vacuum cleaners generally include in the cleaner body a rotary brush chamber, having a suction port that accommodates the rotary brush, a turbine chamber partitioned off from the rotary brush chamber by a partition and interconnected with the rotary brush chamber via a passage formed in the partition, and a turbine rotatably supported in the turbine chamber to be rotated by the drawn air and which rotatably supports the rotary brush.

FIG. 1 is a partial exploded perspective view showing a typical example of the suction device of the vacuum cleaner, and FIG. 2 is a sectional view showing the suction device of FIG. 1 following assembly.

As shown in FIGS. 1 and 2, the conventional suction device of the vacuum cleaner includes a suction device body 10, a rotary brush 20, a turbine 30 and a passage defining member 40.

The suction device body 10 has an upper and a lower casing member 11, 12, which are oppositely connected to each other. Inside of the suction device body 10 is a rotary brush chamber 14 and a turbine chamber 15. The rotary brush chamber 14 also has a suction port 12*a* (FIG. 2) formed in the lower casing member 12 to interconnect the lower casing member 12 with the rotary brush chamber 14. The rotary brush chamber 14 and the turbine chamber 15 are partitioned off from each other by a wall or partition 16. At about the center of the partition 16, a passage hole 16*a* is formed to provide fluid communication between the rotary brush chamber 14 and the turbine chamber 15.

The rotary brush 20 is rotatably disposed in the rotary brush chamber 14 of the suction device body 10, and the turbine 30 is rotatably disposed in the turbine chamber 15 of the suction device body 10. The rotary brush 20 and the turbine 30 are connected with each other through a power transmitting means, such as a timing belt 50. As the turbine 30 rotates, the rotary brush 20 rotates accordingly. The turbine 30 is rotated by the air current, which is drawn into the suction device of the vacuum cleaner through the suction port 12*a*, the rotary brush chamber 14, the passage hole 16*a*, and the turbine chamber 15, and then through an extension pipe (not shown) that is connected to the turbine chamber 15.

The rate of revolution (RPM) of the turbine 30 varies depending on the shape and speed of the drawn air current, and in order to increase the RPM of the turbine 30, the speed of the air passing through the passage hole 16*a* is increased.

The passage defining member 40 is mounted within the passage hole 16*a* for providing a means to accelerate the air current that passes through the passage hole 16*a* Passage defining member 40 defines a narrower air passage 40*a* by restricting the air passage at approximately at the lower center of the passage hole 16*a*. Accordingly, the air is drawn into the turbine chamber 15 from the rotary brush chamber 14 through the air passage 40*a* at a higher speed, thereby rotating the turbine 30 at a higher speed.

In the conventional suction device of the vacuum cleaner constructed as described above, the passage defining member 40 is mounted on the passage hole 16*a* of the lower casing member 12, with the upper casing member 11 being coupled to the lower casing member 12 by a plurality of screws. The suction device is also attached to the extension pipe of the vacuum cleaner (not shown).

In operation, the dust-laden air from the surface to be cleaned is drawn into the cleaner body through the suction port 12*a*, the rotary brush chamber 14, the air passage 40*a* of the passage defining member 40 and into the turbine chamber 15. At this time, the turbine 30 in the turbine chamber 15 is rotated fast by the air current that passes through the air passage 40*a* at a high speed, and accordingly, the rotary brush 20 scratches or strokes the surface to be cleaned in rotational movement to dislocate and cause the dust to float in the air.

In the conventional suction device of the vacuum cleaner, in order to increase the RPM of the turbine 30, the passage defining member 40 is disposed within the passage hole 16*a* that connects the rotary brush chamber 14 and the turbine chamber 15. Accordingly, to receive the air flow from the air passage 40*a* of the passage defining member 40, the outer circumference of the turbine 30 is maintained below a predetermined distance with respect to the bottom surface of the passage. This causes a problem, as relatively larger particles of the contaminants in the dust-laden air come in between the air passage 40*a* and the turbine 30, restricting the rotation of the turbine 30. When this happens, a user of the vacuum cleaner has to separate the upper and lower casing members 11, 12 in order to remove the contaminants in between the air passage 40*a* and the turbine 30, which is very cumbersome and inconvenient. Because the air passage 40*a* is formed inside the suction device body 10, the user does not have a choice but to disassemble the suction device body 10 to remove the contaminants stuck between the air passage 40*a* and the turbine 30. As a result, the user is inconvenienced in performing maintenance and repair.

SUMMARY OF THE INVENTION

The present invention tends to overcome the above-mentioned problems of the conventional vacuum cleaner suction devices. Accordingly, it is an object of the present invention to provide a suction device for a vacuum cleaner that solves the problem of restriction on the rotation of the turbine, i.e., it is the object of the present invention to provide the suction device of the vacuum cleaner that provides a convenient maintenance and repair by enabling the easy removal of the contaminants from between the air passage and the turbine.

The above object is accomplished by providing a suction device of a vacuum cleaner according to the present invention, including a suction device body having an upper casing member and a lower casing member disposed oppositely thereto, and coupled with, the upper casing member, a rotary brush chamber having a suction port formed therein, and a turbine chamber partitioned off from the rotary brush chamber by a partition and interconnected with the rotary brush chamber through a passage formed in the partition; a rotary brush rotatably supported in the rotary brush chamber; a turbine rotatably supported in the turbine chamber and rotated by an air current drawn into the vacuum cleaner, the turbine for driving the rotary brush; a portion defining a service hole formed on the turbine chamber of the suction device body, for partially exposing the turbine; a service hole cover removably mounted on the service hole; and locking means for removably supporting the service hole cover on the lower casing member.

According to the present invention, when contaminants clog the space between the passage and the turbine, hindering the rotation of the turbine, the contaminants can be easily removed through the service hole that is opened by opening the service hole cover. Instead of separating the upper and the lower casing members of the suction device body, the service hole cover alone can be separated for the removal of contaminants, and accordingly, maintenance of the vacuum cleaner is simplified.

According to the preferred embodiment of the present invention, the service hole is formed in the lower casing member of the suction device body, interconnecting with an air passageway, and the service hole cover has a pair of passage walls for defining a narrower air passage in the air passageway.

The turbine chamber of the lower casing member has a pair of arc-shaped guide ribs that have a radius of curvature identical with the radius of curvature of the turbine and are formed on both sides of the turbine chamber, and the pair of passage walls have curved portions that are formed on the pair of passage walls and contacted with the pair of arc shaped guide ribs.

The locking means includes a pair of resilient parts having locking protrusions formed on both sides of the service hole cover to be resiliently biased outwardly from the service hole; and a pair of locking grooves formed in both sides of the service hole to correspond with the suction device body for receiving the locking protrusions.

The resilient parts have press parts extended vertically from the ends of the resilient parts, and receiving grooves formed in corresponding portions of the suction device body to receive the press parts, respectively.

BRIEF DESCRIPTION OF THE DRAWINGS

The above-mentioned objects and the feature of the present invention will be more apparent by describing the preferred embodiment of the present invention in detail referring to the appended drawings, in which.

DETAILED DESCRIPTION OF PREFERRED EMBODIMENT

Figure 1:
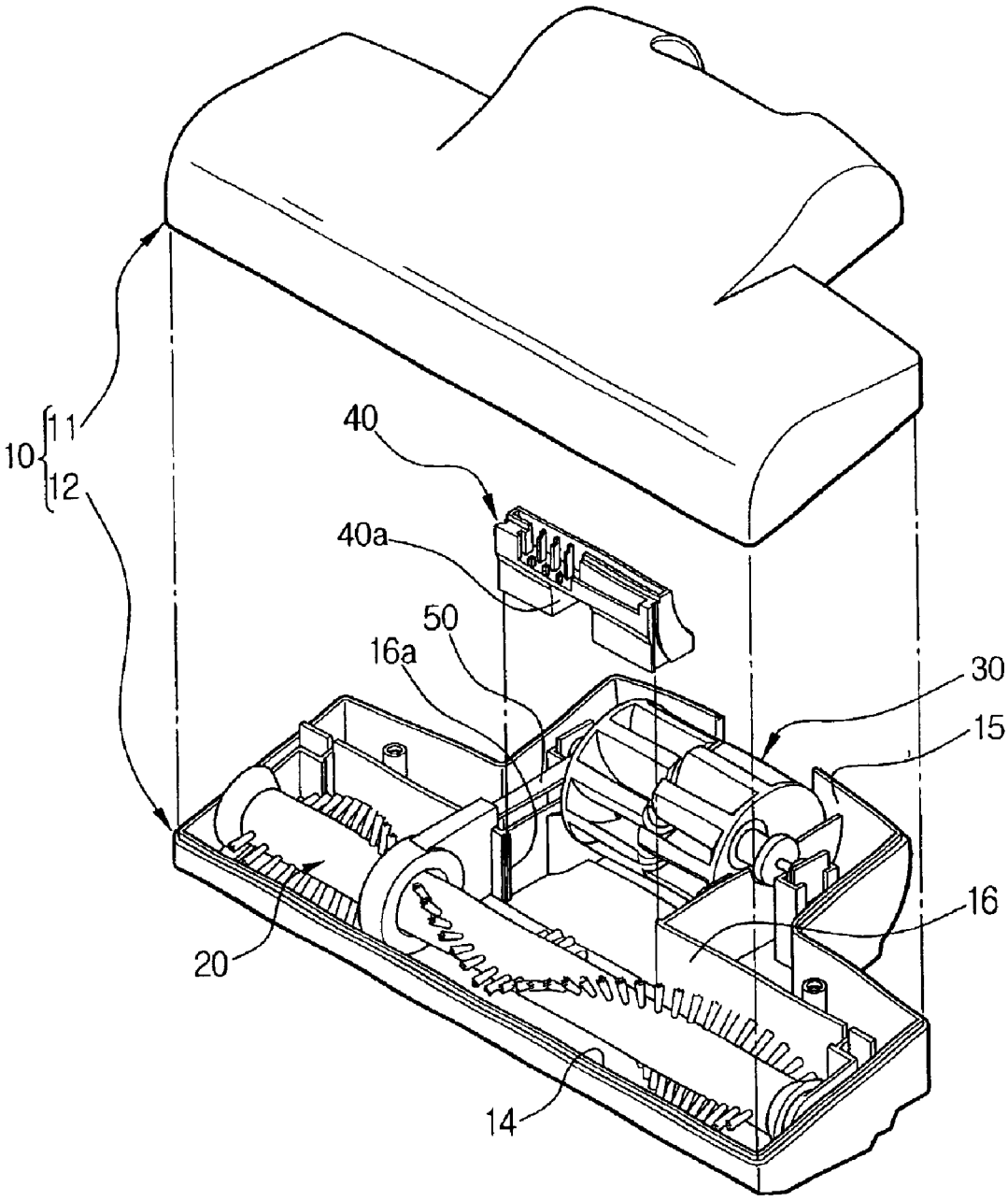
FIG. 1 (PRIOR ART)
FIG. 1 is a partial exploded perspective view showing one example of a conventional suction device of a vacuum cleaner.
Figure 2:
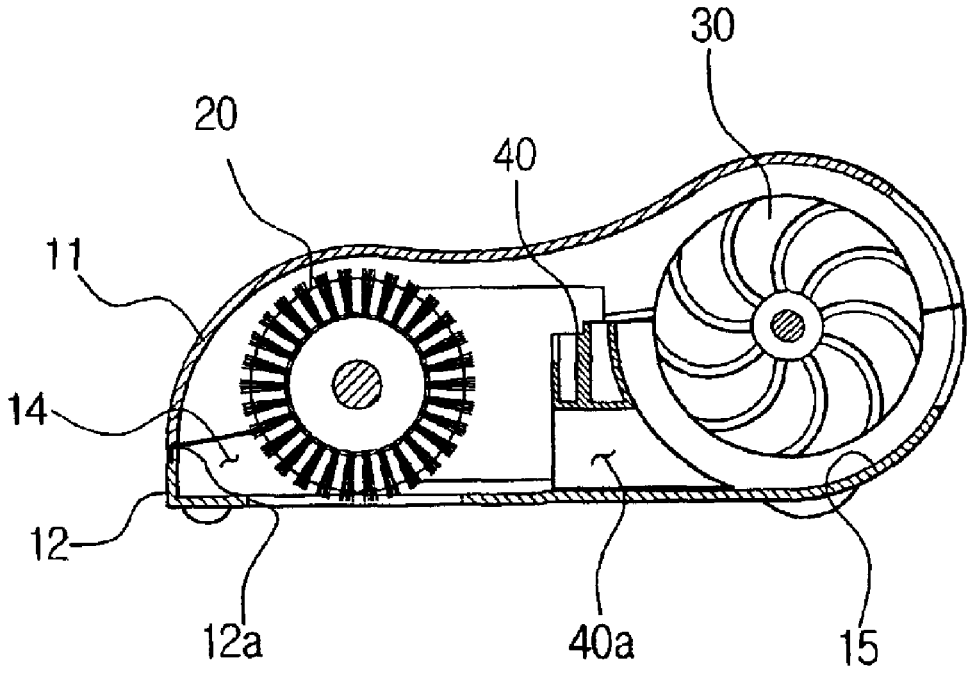
FIG.2 (PRIOR ART)
FIG. 2 is a cross-sectional view showing the suction device of FIG. 1 following assembly.
Figure 3:
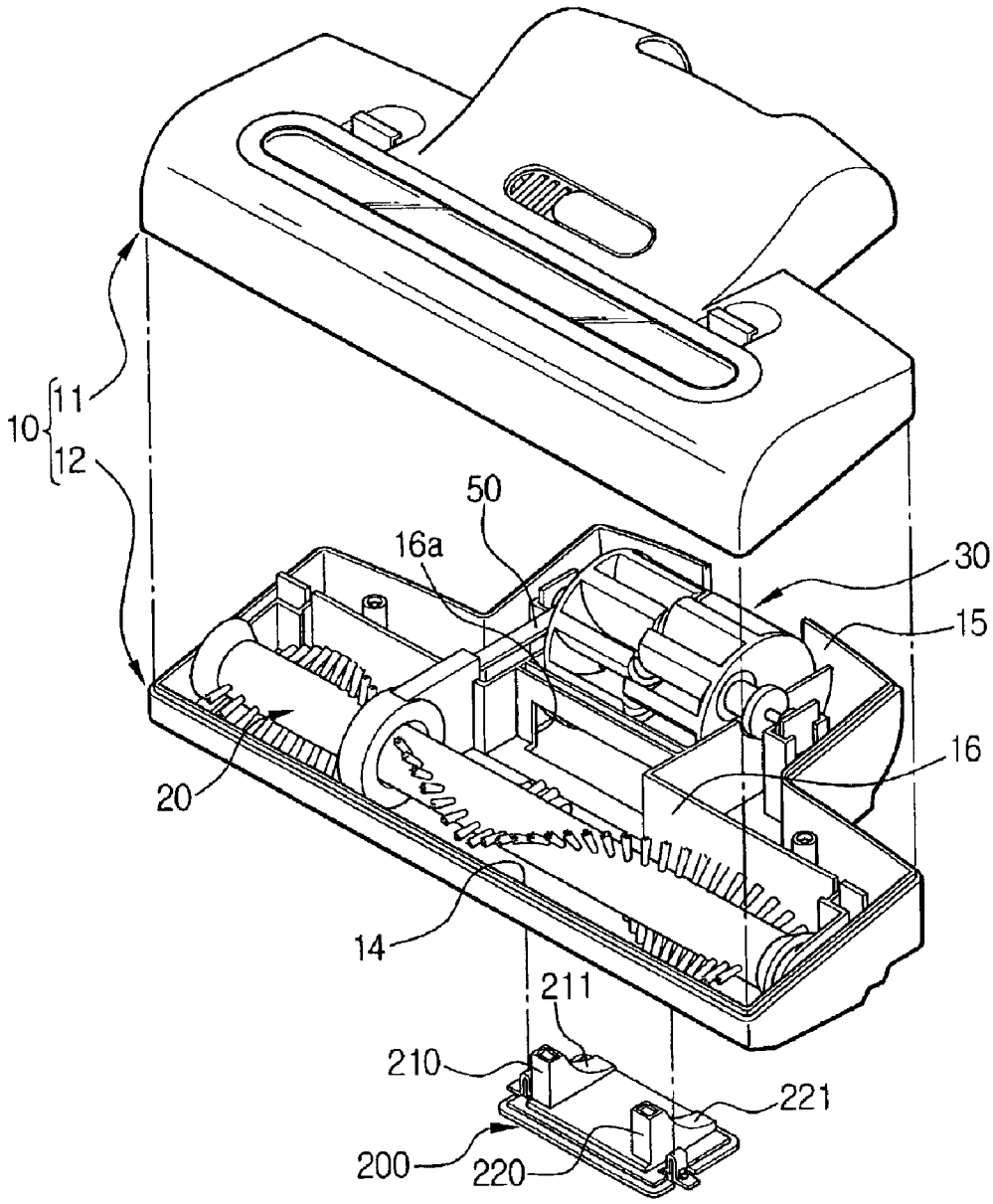
FIG. 3 is a partial exploded perspective view showing a suction device of a vacuum cleaner according to a preferred embodiment of the present invention.
Figure 4:
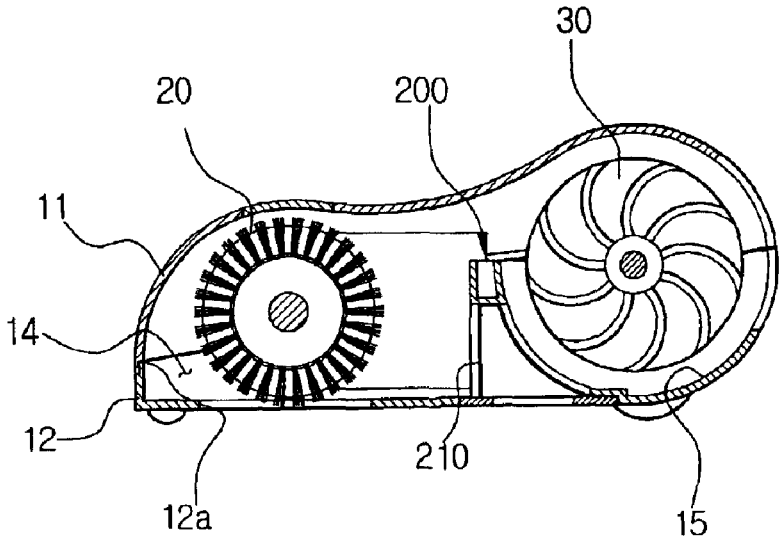
FIG. 4 is a cross-sectional view showing the suction device of FIG. 3 following assembly.

The present invention will be described in greater detail with reference to the accompanying drawings. Throughout the description, like elements will be given identical reference numerals.

As shown in FIGS. 3, 4, 6 and 7, the suction device of a vacuum cleaner according to a preferred embodiment of the present invention includes a suction device body 10, a rotary brush 20, a turbine 30, a service hole 100, a service hole cover 200 and a locking means 300.

The suction device body 10 has an upper casing member 11 and a lower casing member 12 that are oppositely disposed and connected to each other. The suction device body 10 includes a rotary brush chamber 14 and a turbine chamber 15. The rotary brush chamber 14 has a suction port 12*a* (FIG. 4) formed in the lower casing member 12 to provide access into the lower casing member 12 and the rotary brush chamber 14. The rotary brush chamber 14 and the turbine chamber 15 are partitioned off from each other by a wall or partition 16, and the partition 16 has an air passage hole 16*a* for interconnecting the rotary brush chamber 14 and the turbine chamber 15.

The rotary brush 20 is rotatably disposed in the rotary brush chamber 14 of the suction device body 10, and the turbine 30 is rotatably disposed in the turbine chamber 15 of the suction device body 10. The rotary brush 20 and the turbine 30 are connected to each other by a proper power transmitting means, such as a timing belt 50. As the turbine 30 rotates, the rotary brush 20 rotates accordingly. The turbine 30 is rotated by the air as it is drawn in through the suction port 12*a*, the rotary brush chamber 14, the air passage hole 16*a* and the turbine chamber 15, and then through an extension pipe (not shown) that is connected to the turbine chamber 15.

Figure 5:
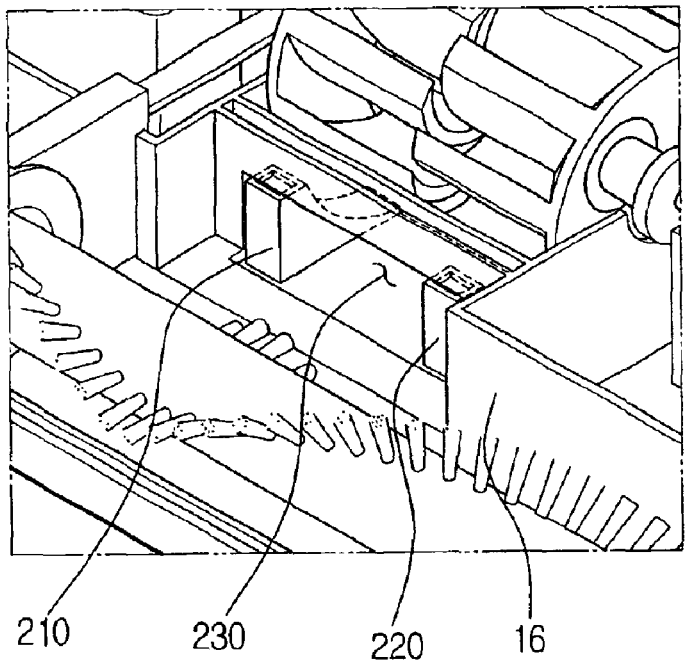
FIG. 5 is a detailed view showing an air passage defined by a service hole cover according to the present invention.
Figure 6:
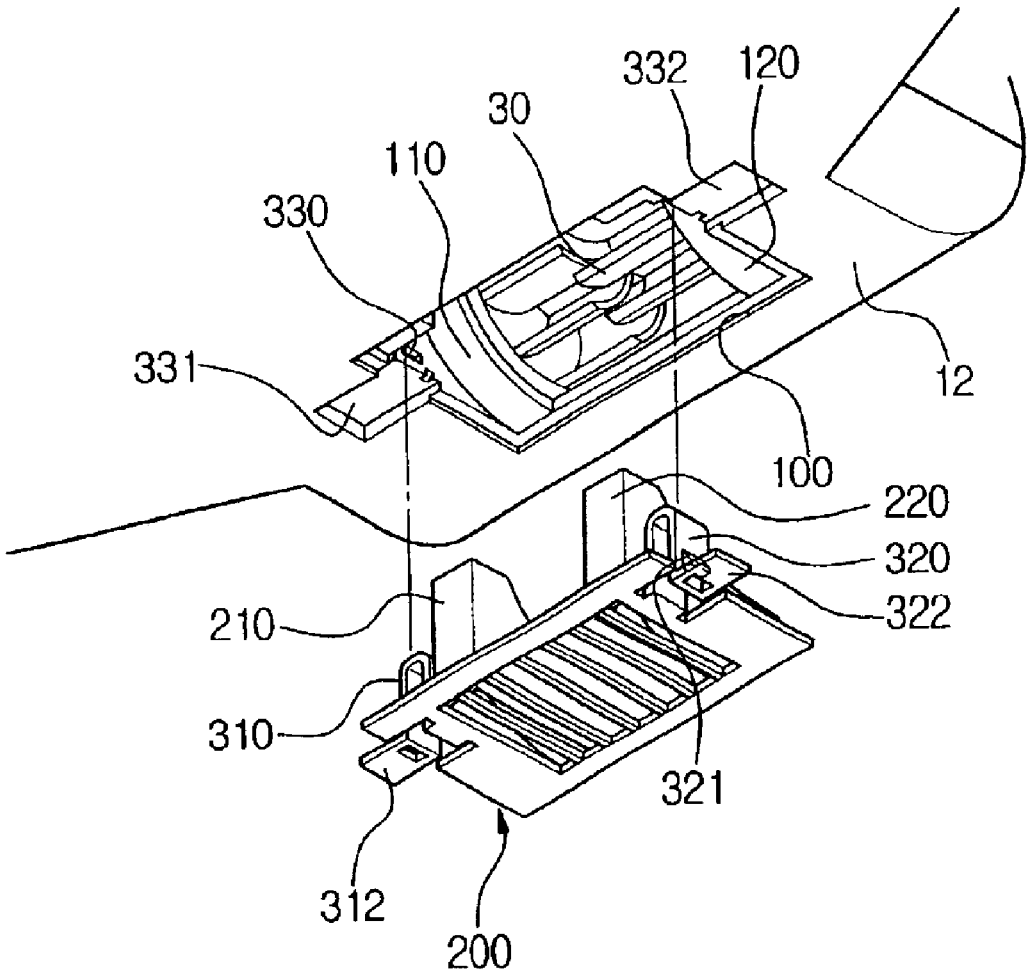
FIG. 6 is a bottom perspective view showing a lower casing member having a service hole, and also showing a service hole cover mounted on the service hole according to the present invention.

As more clearly shown in FIGS. 5 and 6, the service hole 100 is formed adjacent the turbine chamber 15 of the suction device body 10. More specifically, the service hole 100 is formed at the turbine chamber 15 of the lower casing member 12, and, when open, partially exposing the turbine 30 inside the turbine chamber 15. Accordingly, without having to separate the upper and lower casing members 11, 12, repairing of the turbine 30, for example, contaminant removal, can be performed through the service hole 100. The service hole 100 is interconnected with the air passage hole 16*a* inside the suction device body 10. Additionally, a pair of arc-shaped guide ribs 110, 120 are formed within the turbine chamber 15, at opposite sides of the service hole 100. Each of the arc-shaped guide ribs 110, 120 has the same radius of curvature as that of the turbine 30.

As shown in FIG. 6, the service hole cover 200 is removably mounted on the service hole 100. Accordingly, the service hole 100 is closed during cleaning operation, and opened for appropriate purposes, for example, repairing of the suction device. The service hole cover 200 has a pair of passage defining walls 210, 220 formed on opposite inner sides of the service hole cover 200. The pair of passage defining walls 210, 220 define an air passage 230 that is narrower than the air passage hole 16*a* (FIG. 5).

Accordingly, air is drawn from the rotary brush chamber 14 via the air passage 230 into the turbine chamber 15 at a faster speed, and the turbine 30 is rotated faster.

In the case of conventional vacuum cleaners, the flow of the air current was accelerated by disposing the air passage inside the suction device body 10, which often caused inconveniences as contaminants clog in between the air passage and the turbine 30 and subsequently restricts the rotation of the turbine 30. It was also cumbersome for a user to remove the contaminants because he/she had to separate the upper and the lower casing members 11, 12 from each other to gain access to the passage hole 16*a*.

According to the present invention, since the turbine chamber 15 is opened exposing the turbine 30, and since the air passage is drawn out together with the service hole cover 200, contaminants can be easily removed. Meanwhile, a pair of curved portions 211, 221 (FIG. 3) are formed in the pair of passage defining walls 210, 220 in contact with the pair of arc shaped guiding ribs 110, 120 that are formed in the turbine chamber 15. Accordingly, the service hole cover 200 is accurately guided to the mounting position.

Figure 7:
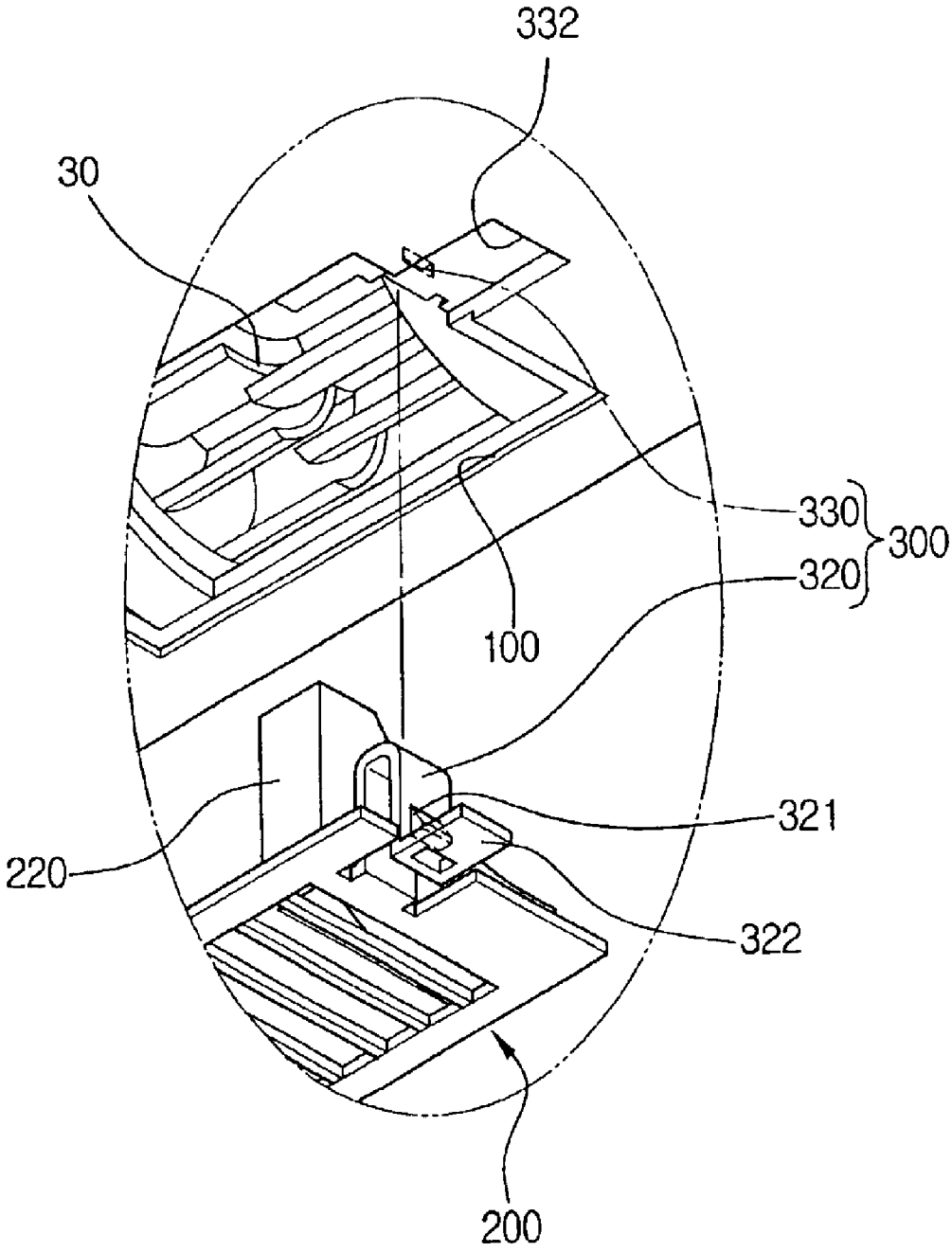
FIG. 7 is a detailed view showing a locking structure of the service hole cover.

The locking means 300 is for supporting the service hole cover 200 in a removable manner. As shown in FIGS. 6 and 7, the locking means 300 includes a pair of resilient parts 310, 320. The resilient part 320 has a locking protrusion 321 formed on one side of the service hole cover 200 to be resiliently biased outwardly from the resilient part 320, and a locking groove 330 formed on one side of the service hole 100 to correspond with the suction device body 10. Likewise, the resilient part 310 has a locking protrusion (not shown) formed on the other side of the service hole cover 200 to be resiliently biased outwardly from the resilient part 310, and a locking groove 330 formed on the other side of the service hole 100 to correspond with the suction device body 10.

The resilient parts 310, 320 also have press parts 312, 322 vertically extended from the ends of the resilient parts 310, 320, and receiving grooves 331, 332 formed in corresponding relation with the suction device body 10 to receive the press parts 312, 322.

In the suction device of the vacuum cleaner constructed as described above according to the present invention, the upper and the lower casing members 11, 12 are coupled with each other by a plurality of screws, and the service hole cover 200 is lockingly mounted on the service hole 100 by the locking means 300. The mounting of the service hole cover 200 is maintained as the service hole cover 200 is pressed to correspond with the service hole 100 of the suction device body 10, and as the locking protrusions 311, 321 of the resilient parts 310, 320 of the service hole cover 200 are locked in the locking grooves 330 of the suction device body 10. The press parts 312, 322 are not projected as they are received in the receiving grooves 331, 332 of the suction device body 10.

For separating the service hole cover 200, the press parts 312, 322 are pressed inwardly, and the resilient parts 310, 320 pulled out, causing the locking protrusions 311, 321 of the resilient parts 310, 320 to separate from the locking grooves 330 to enable the service hole cover 200 to be removed.

The suction device according to the present invention as described above is employed in the vacuum cleaner by being mounted on the extension pipe of the vacuum cleaner, and the dust-laden air from the surface to be cleaned is drawn into the cleaner body via the suction port 21*a*, the rotary brush chamber 14, the air passage 230, and the turbine chamber 15. At this time, by the air current passing through the air passage 230 at a fast speed, the turbine 30 disposed in the turbine chamber 15 is rotated, rotating the rotary brush 20, which accordingly scratches or strokes the surface to be cleaned and letting the dust to float in the air.

At this time, by the reason as described earlier in the description of the prior art, the contaminants may clog in between the passage 230 and the turbine 30, hindering the rotation of the turbine 30. However, since the service hole cover 200 can be easily separated from the service hole 100 according to the present invention, the opening of the service hole 100 and contaminant removal can be performed easily. More specifically, when the service hole cover 200 is opened, the turbine 30 is exposed, while the air passage 230 is drawn out together with the service hole cover 200, which allows easy removal of contaminants. According to the present invention, there is no need to separate the upper and the lower casing members 11, 12 of the suction device body 10 to remove the contaminants. Accordingly, maintenance and repairing of the suction device body 10 is done with ease.

As described, according to the present invention, when the rotation of the turbine 30 is deteriorated by the contaminants clogging in between the passage and the turbine 30 during the cleaning operation, the service hole cover 200 is opened, so that the contaminants can be removed very easily through the open service hole 100. Accordingly, maintenance and repairing of the cleaner becomes simpler, and convenience in using the cleaner is improved.

Although the preferred embodiment of the present invention has been described, it will be understood by those skilled in the art that the present invention should not be limited to the described preferred embodiment, but various changes and modifications can be made within the spirit and scope of the present invention as defined by the appended claims.

What is claimed is:

1. A suction device of a vacuum cleaner, comprising:

a suction device body having an upper casing member and a lower casing member disposed oppositely to, and coupled with, the upper casing member;

a rotary brush chamber having a suction port formed therein; and a turbine chamber partitioned off from the rotary brush chamber by a partition and interconnected with the rotary brush chamber through a passage formed in the partition;

a rotary brush rotatably supported in the rotary brush chamber;

a turbine rotatably supported in the turbine chamber and rotated by an air current drawn into the vacuum cleaner, the turbine driving the rotary brush;

a portion defining a service hole formed in the lower casing member of the suction device body, for partially exposing the turbine, the service hole being interconnected with an air passage;

a service hole cover having a pair of passage walls, defining a narrow air passageway, said service hole cover being removably mounted on the service hole;

and locking means for removably supporting the service hole cover.

2. The suction device of claim 1, wherein the turbine chamber of the lower casing member has a pair of arc-shaped guide ribs that have a radius of curvature identical with the radius of curvature of the turbine and are formed on both sides of the turbine chamber, and the pair of passage walls have curved portions that are formed on the pair of passage walls and shaped and dimensioned to contact the pair of arc-shaped guide ribs.

3. The suction device of claim 1, wherein the locking means comprises: a pair of resilient parts having locking protrusions formed on both sides of the service hole cover to be resiliently biased outwardly from the service hole; and a pair of locking grooves formed in both sides of the service hole to correspond with the suction device body for receiving the locking protrusions.

4. The suction device of claim 3, wherein the resilient parts have press parts extended vertically from the ends of the resilient parts, and receiving grooves formed in corresponding opposed section the suction device body to receive the press parts, respectively.

* * * * *